United States Patent [19]

von Resch

[11] Patent Number: 4,551,945

[45] Date of Patent: Nov. 12, 1985

[54] HARDWARE FOR MOVING A SASH INTO LATERALLY DISPLACED PARALLEL POSITIONS

[75] Inventor: Julius M. von Resch, Stuttgart, Fed. Rep. of Germany

[73] Assignee: Gretsch-Unitas GmbH Baubeschläge, Ditzingen, Fed. Rep. of Germany

[21] Appl. No.: 532,582

[22] Filed: Sep. 15, 1983

[30] Foreign Application Priority Data

Sep. 18, 1982 [DE] Fed. Rep. of Germany ..... 3234677

[51] Int. Cl.[4] ..... E05D 15/10

[52] U.S. Cl. ..... 49/221; 49/130

[58] Field of Search ..... 49/219, 128, 246, 129, 49/130, 248, 193, 221

[56] References Cited

U.S. PATENT DOCUMENTS 2,604,674 7/1952 Johnson ..... 49/193 X 4,412,404 11/1983 Manning ..... 49/193 X

*Primary Examiner*—Philip C. Kannan

*Attorney, Agent, or Firm*—Toren, McGeady, Stanger, Goldberg & Kiel

[57] ABSTRACT

A sash is mounted in a first position in a fixed frame and is movable laterally into a second position where it is parallel to the first position. A plurality of swing arms connect the sash to a movable carriage so that in the second position the sash can be moved along a linear path between a closed position and open position relative to the first position of the sash in the fixed frame. At least one of the swing arms has a control arm pivotally attached to it. The control arm has a locking member engageable within and movable along a slot in the carriage. The locking member can be secured within a section of the slot angularly offset from the main section of the slot when the sash is in the second position. With the locking member secured in the angularly offset section, the sash is retained in the second position. A lug secured to the fixed frame is located in the path of the carriage as the sash moves along the linear path toward the closed position. A stop formed on the lug is contacted by the locking member when the sash moves toward the closed position so that the locking member is automatically disengaged from the offset slot section and the control arm and the swing arm can be pivoted relative to one another. The stop is part of a second slot and with the sash in the first position, the second slot holds the locking member so that the sash is retained in the fixed frame.

12 Claims, 5 Drawing Figures

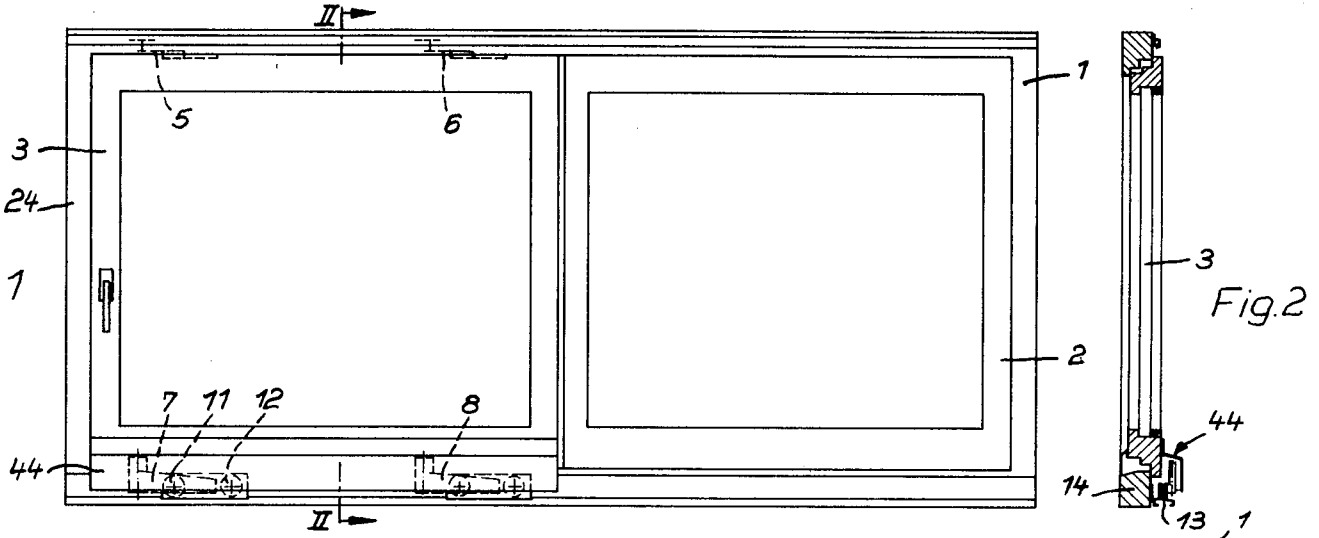
Fig. 1
Fig. 2
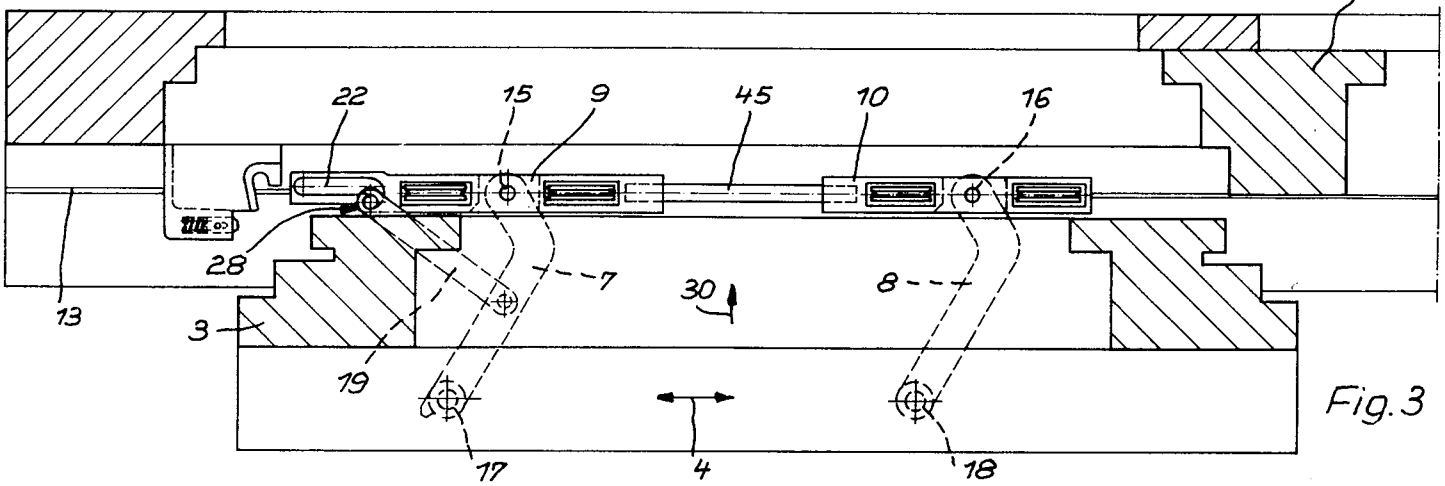
Fig. 3

HARDWARE FOR MOVING A SASH INTO LATERALLY DISPLACED PARALLEL POSITIONS

SUMMARY OF THE INVENTION

The present invention is directed to hardware for a sash in a window, door or the like so that the sash can be moved laterally from a first position into a parallel second position with the movement being effected by swing arms. In the second position the sash can be moved along a linear path. A disengageable holding apparatus for at least one of the swing arms is engageable in the parallel second position. Hardware of this general type has been known. Such hardware retains the sash in the parallel second position so that neither the force of wind or manual force exerted against the sash can move it back into the first position.

Therefore, the primary object of the present invention is to provide hardware of the type mentioned above so that the sash can be secured in the parallel second position in a different and advantageous manner.

In accordance with the present invention, hardware is provided so that a sash in a window or a door can be moved laterally from a fixed first position into a second position parallel to the first position and in the second position can be moved along a linear path. The sash is attached to a number of swing arms so that it can be moved between the two positions. The hardware is arranged to secure the sash in the first and second positions so that accidental displacement cannot take place. In a simple and inexpensive manner, the hardware secures at least one of the swing arms, relative to the sash and a fixed frame so that it is retained in the second position. If, for example, four swing arms are used and one of the swing arms is secured, specifically the lower swing arm in the closing direction, then the securing arrangement is sufficient to assure that all of the swing arms are held in position due to the rigidity of the sash. It is unimportant whether the sash is moved into the parallel second position, possibly through a prior tilting position either by the control of the hardware or by a simple pulling out movement. It is advisable if this hardware is used on a sash which is moved into the parallel second position and which can be displaced in the second position relative to the fixed frame, that is the frame in which the sash is located in the first position. Further, an additional sash can be provided which can be arranged to remain in the closed position or as a rotating or rotating-tilting sash. In addition, the second sash may also be slidable.

The hardware includes a control arm pivotally connected to one of the swing arms for forming a Y-shaped pivotal scissors for providing a particularly rigid and stable support for the corner of the sash to which the control arm is assigned. A locking member is provided on the control arm and is engageable in a catch receiver so that when the locking member enters the receiver when the sash is moved into the second position, the sash is retained in that position against any counterforce which might accidentally displace the sash back toward the first position. The displacement of the locking member out of the catch receiver only takes place when a particular action on the locking member is effected. When such disengagement takes place, the control arm and the swing arm can pivot relative to one another in the horizontal direction. In an advantageous arrangement, the swing arm and the control arm are arranged one above the other when the sash is in the closed or first position.

In a particularly preferred embodiment, the catch receiver is formed by a slot section extending angularly from a main section through which the locking member can be moved. The locking member is in the form of a pin secured to the control arm. When the sash is moved into the second position the pin engages in the angular slot section. The main section of the slot extends in the sliding or linear movement direction of the sash and the angular slot section extends at an angle of less than 90° with respect to the main slot section. The angular slot section is directed approximately in the direction in which the sash moves from the first into the second position. Further, the angular slot section is located at the trailing end of the main slot section in the sliding-closing direction of the sash. Due to the slightly inclined position of the angular slot section where it is at an angle of about 60° relative to the main slot section, the locking member or pin is pressed against the inclined side wall of the angular slot section when a force is applied against the wing in the closing direction with the side wall acting as stop preventing a horizontal pivotal movement of the control arm toward the plane of the sash. Further, in forming the Y-shaped pivotal scissors, the control arm is shorter than the swing arm and the end of the control arm is pivoted approximately to the center of the swing arm. Since the sash is normally moved into a parallel position in the interior of the room relative to the closed first position, a movement "in the opening direction of the sash" is directed into the interior of the room.

Another advantageous feature of the hardware embodying the present invention is a blocking device for at least one of the swing arms so that it can be disengaged relative to a fixed frame for the sash by the sliding movement of the sash. The blocking device includes a stationary stop arranged in the path of the locking member so that the locking member engages the stationary stop in the sliding-closing movement of the sash. The stationary stop is formed by the longer edge of a second or disengaging slot which extends transversely relative to the sliding or linear movement direction of the sash. The second slot is open at one end in the direction of movement of the sash from the first into the second positions. When the sash in the second position is displaced in the closing direction, the locking member on the control arm engages the longer edge of the second or disengaged slot which edge acts as the stationary stop and contact with the stop is effected when the sash is aligned opposite the first or closed position of the sash relative to the fixed frame. Since the disengaging slot is slightly inclined to the direction of movement of the sash between the first and second positions and extends in the opposite direction relative to the angular slot section of the control slot, the slightly inclined stop edge affords a displacement of the locking member in the direction of the sash. Accordingly, the locking member moves out of the angular slot section of the control slot and moves into the main slot section. Since the main slot section extends in the sliding movement direction, that is the long direction of the upper and lower sides of the sash, the main slot section of the control slot can be displaced relative to the locking member with the locking member held in a stationary position. This movement takes place as the moving carriage for the sash is displaced in a linear direction along a track opposite to the closing direction. When the locking member moves out of the angular slot section of the control slot, there is a folding action of the control arm and the swing arm toward the plane of the sash. At the same time, the sash can be placed into the opening of the fixed frame, that is, it can be moved from the second position into the first position, possibly passing through an intermediate tilted position. In the first position it need only be locked relative to the fixed frame.

Accordingly, this automatic control for disengaging the blocking device at the same time forms an auxiliary means for guiding the sash as it moves from its open position to the closed position in a secure and problem-free manner. When the sash is guided into the closed position it is not possible for the sash to spring back and no special attention is required to effect a disturbance-free guidance of the sash in the open second position into the tilted and/or closed position. Moreover, this hardware involving the present invention is particularly simple, it is composed of few parts, and operates in an absolutely reliable manner.

In another feature of the invention, the locking member extends through the control slot and its end projecting from the slot cooperates with the second or disengaging slot. Accordingly, when the locking member is arranged at the lower end of the sash in the closing direction, it projects through the control slot from a point above the slot to a point below the slot.

In still another feature, the control slot is located in an elongated tongue projecting from one end of the movable carriage, that is the end of the carriage facing in the closing direction. The elongated tongue extends as a continuation of the movable carriage. Accordingly, a particularly compact arrangement is afforded which avoids the projection of the hardware into the interior of the room in which the sash is located. The elongated tongue does not extend into the interior of the room beyond the region of the track on which the carriage moves or the region of the lower member of the fixed frame.

In the invention, the second slot forming the stationary stop is located in a bracket secured to the lower corner of the fixed frame, that is, the corner toward which the sash moves in the closing direction. The second slot is open at one end and extends in the direction of movement of the sash between the first and second positions. Accordingly, it is possible to move the end of the locking member projecting downwardly from the control slot into the second slot.

In a particularly desirable manner, the bracket on the fixed frame has a bore for receiving the elongated tongue on the movable carriage and the bore is open in the direction facing in the sliding/opening direction of the sash. When the sash in the second position is moved toward the closed position, the elongated tongue on the carriage initially enters into the bore in the bracket and then, when the end of the sash is moved back into the tilted position and the carriage is displaced in the opening direction relative to the sash, the elongated tongue moves out of the bore. In the closed position, and also possibly in the tilted position, the elongated tongue is located outside of the bore in the bracket.

Another desirable feature of the invention is the use of a spring or similar member for biasing the control arm in the direction of movement into the angular slot section of the control slot with the spring connected between the control arm and the swing arm to which it is pivoted. The spring acts in such a manner that when the sash is moved from the first position out into the second position, the control arm is pivotally displaced in the horizontal direction so that the locking member enters into the angular slot section as soon as it arrives at that end of the control slot after movement along the main slot section.

Another desirable embodiment of the invention involves the provision of a locking shoulder or projection at the end of the swing arm which is connected with the control arm, that is the end secured to the sash. When the sash is closed, the locking shoulder engages behind a spring-loaded stationary locking bolt so that the locking bolt and shoulder form a locking device for the sash in the closed position. It is noted that the sash is first guided from the closed position into the tilted position. This locking arrangement secures the lower portion of the sash which has not been displaced outwardly against any accidental pivotal movement into the parallel second position. By exercising a displacing force against the spring biasing the locking bolt into the locked position, the sash can be moved out of the first position in the fixed frame and displaced into the parallel second position. When the sash is pivoted back into the tilted position this locking arrangement automatically secures it in place. The locking bolt and its biasing spring are located in a desirable manner in a lateral extension in the bracket secured to the fixed frame. This lateral extension projects into the room interior and the extension is arranged, at least in part, above the plane of the second slot. The height of the position is determined according to the shape and arrangement of the swing arm relative to the movable carriage and the like. The locking bolt can be guided in the longitudinal direction if its shape should require such guidance. Preferably, the biasing spring is a compression spring.

Finally, in a preferred arrangement of the invention, the hardware located at the lower corner of the sash is enclosed by a cover extending along the length of the sash, preferably the cover is an aluminum section. The cover at least partially encloses the swing arm or arms located along the lower side of the sash so that the hardware is well protected from the outside and is not visible or only slightly visible. This covered arrangement is particularly desirable in windows and doors for aesthetic reasons.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is an elevational view of a window or door equipped with two sash with the left-hand sash provided with the hardware embodying the present invention;

FIG. 2 is a vertical sectional view taken along the line II—II in FIG. 1;

FIG. 3 is an enlarged horizontal section taken through the left half of FIG. 1 with the sash moved into a second position parallel with the first or closed position;

DETAILED DESCRIPTION OF THE INVENTION

Figures 4, 5:
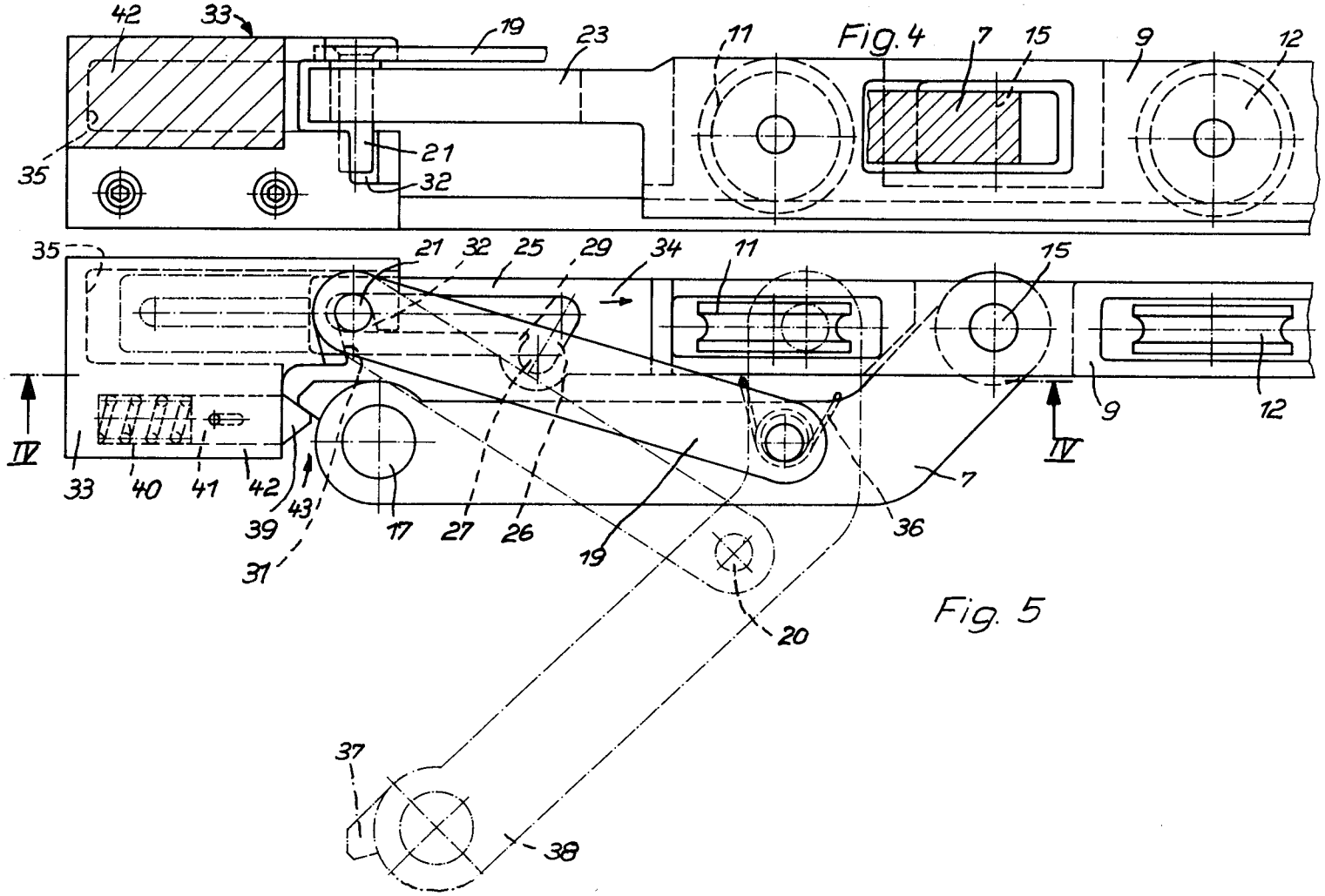
FIG. 4 is a further enlarged side view of a movable carriage and the hardware embodying the present invention shown partly in section.
FIG. 5 is a top view of FIG. 4 illustrating the positions of the swing arm and the control arm when the sash is moved from a first position into a second position with the moved position shown in dash-dot lines.

In FIG. 1 a sash 2 is located within a fixed frame 1 and the sash 2 can be held in a fixed manner in the frame or it can be opened in a known manner, for example by rotating and tilting the sash or by displacing it. Another sash 3 is tiltably mounted in the fixed frame and it is movable from a first position within the fixed frame into a second position where it is parallel to the first position. In the second position it can be moved in the direction of the double arrow 4, note FIG. 3, so that it can be displaced out of the closed position shown in FIG. 1 and moved into an open position opposite the sash 2. The sash 3 is connected to the fixed frame 1 by a number of swing arms, preferably four, with two upper swing arms 5, 6 and two lower swing arms 7, 8. Each of the lower swing arms is supported on a movable carriage 9, 10 as can be seen in FIGS. 4 and 5. The movable carriages are coupled together by a tie rod 45 or the like. Accordingly, the two carriages are movable together. Each carriage 9, 10 has two rollers 11, 12 guided along a linearly extending rail or track 13. The rail 13 is fixed along the side of the lower horizontal member 14 of the fixed frame 1 that is, the side of the frame which faces into the interior of the room in which the sash is located. Pivot bearings 15, 16 for the swing arms 7, 8 are located at the carriages 9, 10 and pivot bearings 17, 18 for the swing arms are located on the sash 3.

A control arm 19 is pivotally secured to the lower swing arm 7 which is located in the trailing position on the sash when it moves toward the sash 2 into the open position. A pivot bearing 20 interconnects control arm 19 and the swing arm 7. At its end spaced from the pivotal connection to the swing arm, the control arm 19 has a locking member 21 in the form of a pin. The locking member or pin 21 extends downwardly through an elongated control slot 22 from above the slot through it so that it has a free end located below the bottom of the slot. The control slot 22 has a main slot section 25 extending in the direction of the double arrow 4 and an angular slot section at one end, that is at the end of the slot facing in the opening direction as indicated by the arrow 34 in FIG. 5. The control slot 22 is located in an elongated tongue 23 extending from one end of the movable carriage 9, that is, the end of the carriage facing in the closing direction with the end of the tongue spaced outwardly from the carriage facing in the direction toward the vertical member 24 at the left-hand side of the fixed frame 1 in FIG. 1, that is the side located in the closing direction of the sash 3. The main slot section 25 of the control slot 22 extends in the sliding direction of the sash 3 indicated by the double arrow 4. The control slot includes an angular slot section 26 extending at an angle of less than 90° relative to the main slot section. The angle of the angular slot section 26 is approximately 60° relative to the main slot section 25. The end of the angular slot section 26 spaced from the main slot section 25 forms a catch receiver 27 for the locking member 21. The locking member 21 engages in the angular slot section 26 in the second position of the sash, note FIG. 3. As can be seen in FIG. 3, the angular slot section 26 provides a disengageable blocking device 28 for the sash 3 when the sash is in the second position parallel to the closed first position. Due to the inclined arrangement of the angular slot section 26 relative to the main slot section 25 or to the plane of the sash, a blocking catch 29 is formed which prevents the locking member from moving back into the main slot section 25 when a force acts against the sash 3 in the direction of the arrow 30, note FIG. 3. Accordingly, the Y-shaped pivotal scissors formed by the lower swing arm 7 and the control arm 19 cannot fold back from the open position shown in FIG. 3 to the closed position shown in solid lines in FIG. 5. As a consequence, the remaining swing arms 5, 6, 8 remain in the open position, as in FIG. 3, and cannot be moved back into the closed position. Accordingly, the sash 3, located in the second position, is securely held in this second position by the blocking device 28.

A stationary stop 31 is provided in the line of movement of the locking member 21, that is, it is positioned in the sliding-closing movement of the locking member. The stationary stop 31 is formed by the longer side of a disengaging slot 32 which extends transversely of the direction of the sliding movement of the sash as shown by the double arrow 4. This second or disengaging slot 32 is open at its end facing outwardly away from the closed position of the sash, that is, the end of the slot 32 in the direction of movement of the sash from the first position to the second position is open. The second slot 32 is located in a bracket 33 secured on the lower corner of the fixed frame 1, that is, the lower corner in the closed position of the sash 3. The upper side of the bracket 33 in the region of the disengaging or second slot 32 is arranged so that the edge of the control arm 19 contacts the slot when the lower edge of the locking pin 21 stops against the longer side 31 of the second slot 32. Bending of the control pin is avoided by this construction if the sash is pushed closed in a hard manner. The other side of the second slot is shorter than the longer side by a dimension approximately equal to the diameter of the locking member 21 so that the locking member can move into the second slot. Further, the disengaging or second slot 32 open at one end, does not extend perpendicularly to the plane of the sash or of the fixed frame, rather it is inclined slightly relative to the perpendicular and is inclined in the opposite direction relative to the direction of the angular slot section 26 of the control slot, note FIG. 5. This inclined arrangement of the second slot has the effect that when the locking member 21 is located within the angular slot section 26, it runs up against the stationary stop 31.

Due to the relative inclined positions of the stationary stop 31 and of the angular slot section 26, the sliding-closing movement of the sash 3 in the parallel second position causes the locking member 21 to move from the angular slot section 26 and simultaneously to enter the disengaging or second slot 32 in the bracket 33, since the end of the second slot is open. This transverse movement of the locking member 21 approximately perpendicular to the plane of the sash or the fixed frame effects a disengagement of the blocking device 28 and permits the relative horizontal pivotal movement of the lower swing arm 7 and the control arm 19 from the position shown in dot-dash lines in FIG. 5 into the end position shown in solid lines in the same figure. When the solid line position is reached, the movement of the lower portion of the sash against the fixed frame is completed. The sash 3 is now located in a tilted position and it can be tilted back into the closed position manually or by a suitable fitting, note the position in FIG. 2.

When the locking member 21 enters into the end of the main slot section 25 at the angular slot section 26 the locking member can move relative to the main slot section in the direction of the arrow 34, note FIG. 5, so that the folding of the Y-shaped pivot scissors is effected from the opened to the closed position. This movement of the main slot section 25 relative to the locking member 21 results in the displacement of the elongated tongue 23 and the movable carriage 11, 12 in the direction of the arrow 34 relative to the fixed sash 2. As can be seen in FIG. 5 when the sash 3 is in the end position, that is, when it is closed or tilted from the closed position, displacement of the sash in the direction of the arrow 34 is not possible because such movement is prevented by the cooperation of the shorter second slot side of the slot 32 and the locking member 21. Accordingly, a second blocking action is provided by this disengageable blocking device.

The bracket 33 has a bore 35 arranged to receive the elongated tongue 23 on the end of the movable carriage 9 and the bore 35 is open in the sliding-opening direction 34. As illustrated by dot-dash lines in FIG. 5, the tongue 23 on the carriage 9 enters into the bore 35 at the beginning of the sliding-closing movement and it exits from the bore only when the lower portion of the sash 3 moves back against the fixed frame 1. In the tilted position or in the closed position of the sash, the tongue 23 is completely moved out of the bore 35 as is shown in FIG. 4. Further, as shown in FIG. 5, a spring 36 biases the control arm in the direction of its engagement movement in the angular slot section 26 of the control slot 22 and the spring is connected between the control arm 19 and the swing arm 7. It is advisable if the spring 36 is a spiral spring with a pair of spaced legs, note FIG. 5.

A locking projection 37 on the end of the swing arm 7 closer to the bracket 33 cooperates with a stationary locking device 39 located in the bracket. The locking device or bolt 39 is formed by a wedge-shaped or conically shaped free end of a bolt 41 guided in the long direction and spring loaded in the direction toward the locking projection 37 by a spring 40, preferably a compression spring. The bolt 41 is located within an extension 42 of the bracket 33 with the extension 42 extending in the direction into the interior of the room from the fixed frame. The locking device or bolt 39 and the locking projection 37 form a securing device 43 for the lower end of the sash 3 when the sash is in the closed position. The extension 42 lies at least partially above the plane of the second slot 32 while the second slot is overlapped by the elongated tongue 23 on the carriage 9.

The various parts of the sash hardware located along the lower side of the sash are partially enclosed or covered by a cover member 44, such as an aluminum section, which extends along the length of the sash, as shown in FIG. 1 and FIG. 2. Accordingly, at least the major portion of the lower swing arms 7, 8 cannot be seen from the interior of the room and the blocking device 28 and the securing apparatus 43 are also covered. Aside from its aesthetic function, the cover member 44 also has a securing function in that it prevents unauthorized manipulation of the hardware and protects it from being soiled.

While specific embodiments of the invention have been shown and described in detail to illustrate the application of the inventive principles, it will be understood that the invention may be embodied otherwise without departing from such principles.

I claim:

1. Apparatus for a window or the like comprising a sash and hardware engageable with said sash for moving said sash from a closed first position into a second position parallel to the first position, said hardware comprising swing arms disposed in spaced relation and pivotally connected to said sash, means for linearly displacing said sash in the second position, said means comprising at least one movable carriage, means engageable with at least one of said swing arms for securing said sash in the second position and said securing means being disengageable, said securing means comprises an elongated control arm pivotally secured to one of said swing arms, a locking member mounted on said control arm and spaced from the pivotal connection of said control arm to said swing arm, and arresting means in said carriage for receiving and holding said locking member for positioning said control arm and swing arm so that said sash is maintained in the second position.

2. Apparatus, as set forth in claim 1, wherein said arresting means comprises a control slot located in said carriage, said control slot having a main slot section and an angular slot section extending angularly relative to said main slot section from one end of said main slot section, said locking member includes a pin in sliding engagement in said control slot, said main slot section extends in the linear displacing direction of said sash, and said angular slot section extends relative to said main slot section at an angle of less than 90°, and said angular slot section is directed approximately in the direction from said main slot section that said sash moves from the first position to the second position with said angular slot section located at the leading end of said main slot section in the direction in which said sash can be moved in the second position away from the closed first position.

3. Apparatus, as set forth in claim 2, wherein said swing arm pivotally connected to said control arm is displaceable out of said arresting means by moving said sash in the linear direction toward and parallel to the closed first position, a stationary stop located in the path of movement of said locking member in the closing direction, said sash includes a fixed frame for receiving said sash in the first position, a bracket secured to said fixed frame, a second slot formed in said bracket, said second slot being open at one end and having a longer side and a shorter side with said longer side facing said locking member as it moves in the closing direction, and said second slot being open at the end thereof more remote from said fixed frame, said second slot extends transversely of the linear moving direction of said movable carriage.

4. Apparatus, as set forth in claim 3, wherein said locking member extends through said control slot and has a free end spaced from said control slot and engageable within said second slot.

5. Apparatus, as set forth in claim 2 or 3, wherein an elongated tongue is secured to one end of said movable carriage and extends from said carriage in the closing direction of said sash, said control slot is formed in said elongated tongue, and said elongated tongue forms a continuation of said carriage.

6. Apparatus, as set forth in claim 5, wherein said fixed frame has a lower side, said lower side has a closed end, a lug is located at the closed end of the lower side of said fixed frame and said disengaging slot is open at the end thereof spaced outwardly from said fixed frame.

7. Apparatus, as set forth in claim 6, wherein said bracket has a bore therein for receiving said elongated tongue on said carriage and said bore is open in the direction extending away from the closed end of the lower side of said fixed frame.

8. Apparatus, as set forth in claim 1, 2, 3 or 4 comprises a spring for biasing said control arm in the direction for engagement into said angular slot section of said control slot, and said spring is connected to said control arm and said swing arm.

9. Apparatus, as set forth in claim 3 or 4, including a locking projection located on the end of said swing arm which is connected to said control arm and which end faces toward said bracket, a spring loaded stationary locking device located in said bracket, and said locking projection engages said stationary locking device when said sash is in the closed first position so that said locking projection and stationary locking device secure said sash in the closed first position.

10. Apparatus, as set forth in claim 9, wherein said bracket includes a lateral extension, said locking device and said spring positioned in said lateral extension, and said lateral extension arranged to extend into the interior of a room in which said sash is located, and said lateral extension located at least partially above the plane of said second slot.

11. Apparatus, as set forth in claim 3 or 4, wherein a cover member extends along the lower side of said fixed frame and forms at least a partial cover for said swing arms and said carriages, said cover extends for the full dimension of said sash extending transversely of the direction between the first and second positions.

12. Apparatus, as set forth in claim 11, wherein said cover member is an aluminum section.

* * * * *